US005966851A

United States Patent [19]

Serpa

[11] Patent Number: 5,966,851

[45] Date of Patent: Oct. 19, 1999

[54] SAFETY PRESSING IRON WITH BURN PREVENTION SHIELD

[76] Inventor: Michael Lawrence Serpa, P.O. Box 2693, Newport Beach, Calif. 92659

[21] Appl. No.: 09/164,747

[22] Filed: Oct. 1, 1998

[51] Int. Cl.[6] ..... D06F 75/38; D06F 75/40

[52] U.S. Cl. ..... 38/79; 38/93; 38/77.7

[58] Field of Search ..... 38/77.3, 77.6, 38/77.7, 79, 81, 88, 89, 93, 96, 97, 77.83, 75, 76; 219/245, 246, 248, 258, 259, 522, 523

[56] References Cited

U.S. PATENT DOCUMENTS

| | | | |
|---|---|---|---|
| 1,755,528 | 4/1930 | Wilson | 38/79 |
| 2,076,614 | 4/1937 | Bowman . | |
| 2,149,251 | 3/1939 | Campana . | |
| 2,160,421 | 5/1939 | Sebo | 38/77.6 X |
| 2,382,587 | 8/1945 | Thomas . | |
| 2,445,444 | 7/1948 | Mainwold | 38/97 X |
| 2,470,532 | 5/1949 | Thomas . | |
| 2,642,682 | 6/1953 | Browning | 38/79 |
| 2,833,903 | 5/1958 | Waddell . | |
| 2,957,257 | 10/1960 | Abbott . | |
| 3,050,885 | 8/1962 | Whitfield | 38/70 |
| 4,203,101 | 5/1980 | Towsend . | |
| 4,577,424 | 3/1986 | Liu . | |
| 4,803,342 | 2/1989 | Steers et al. . | |
| 5,535,534 | 7/1996 | Li et al. . | |
| 5,721,418 | 2/1998 | Hazan et al. . | |
| 5,799,422 | 9/1998 | Demuth et al. | 38/93 |

*Primary Examiner*—Ismael Izaguirre

[57] ABSTRACT

An electric pressing iron (20) that has a spring-mounted burn guard (30) to prevent persons or things from inadvertently contacting the hot portions of the iron. Openings (31) in the burn guard are shaped to precisely receive raisedlareas (28) protruding from the iron's heated sole plate (27). The raised areas remain recessed in the openings when the iron is not being used. Upon use, support springs (32) compress and the distal ends of the raised areas extend and act in combination with the burn guard to form a flat ironing base. A connecting arm (47) coordinates movement of the burn guard with a mercury switch (39) that, unless the iron is in an upright position, automatically shuts off power to the heating element when downward pressure on the iron is released.

5 Claims, 8 Drawing Sheets

48
23
21
22
20
26
28
29
37
38
32
25
31
27
30
33

10
9
9
10
31
29
28
30
20
25

SAFETY PRESSING IRON WITH BURN PREVENTION SHIELD

FIELD OF THE INVENTION

This invention relates to electric pressing irons such as those used for ironing clothing and other items, and specifically to pressing irons that include safety features.

DISCUSSION OF PRIOR ART

Numerous designs have been offered to provide a safer electric pressing iron. Many of these designs include an automatic switch that turns the iron off after a period of non-use. Some designs will turn off the iron after a short period if the iron is in the horizontal position and after a longer period if the iron is vertical. A variety of arrangements are proposed, including some that sense movement of the iron and others that respond to a user's grasp.

These designs all offer benefits. However, especially where timer mechanisms are used, they also share a problem in that there will inevitably be some delay before the power to the heating element is cut off. This delay, as well as the residual heat that is in the sole of the iron at the moment the power circuit is broken, results in an iron that could burn a user and possibly even start a fire before the sole has cooled enough to be safe.

Addressing these problems in another manner are designs providing a mechanism that attempts to, during periods of non-use, move the heating element away from the surface being ironed. Most of these designs, however, share a disadvantage in that the heated sole of the iron remains exposed when the sole is not in contact with the surface being ironed. A user could be burned by such an iron left in the upright or rest position even if the iron is equipped with a shut-off switch.

For example, Liu, U.S. Pat. No. 4,577,424 issued Mar. 25, 1986 leaves the sole unprotected when the iron is in the upright position. Though this design includes a shut-off timer, the residual heat in the sole would take time to dissipate and a user could be burned before the sole has cooled sufficiently. Additionally, the disk of the Liu design could interfere with the effectiveness of the iron because it results in a large relatively cool area in the center of the iron sole.

Campana, U.S. Pat. No. 2,149,251 issued Mar. 7, 1939, offers a frame that lifts the iron off the ironing surface when the user releases the handle. This design not only leaves the sole exposed but also relies upon a cumbersome frame apparatus that might not be preferred by all users.

The burn prevention shield described by Li et al., U.S. Pat. No. 5,535,534 issued Jul. 16, 1996, covers only the edge of an iron's sole. The exposed portion of the sole could cause injury when the iron is in a vertical rest position. This design also would not make an unattended horizontal iron safe.

Another design, Bowman, U.S. Pat. No. 2,076,614 issued Apr. 13, 1937, moves the heating element away from the ironing surface when a user releases the handle of the iron. However, the sub-base of the Bowman design remains in contact with the surface being ironed and the residual heat of the sub-base could be sufficient to burn a user or cause damage. This is especially true of the Bowman design because, to be effective, the sub-base must be constructed from a material that is a good heat conductor. Though it includes perforations to aid in cooling, there still might be some delay before the sub-base has cooled enough to be safe for a user and/or fabrics.

Two final designs, Thomas, U.S. Pat. No. 2,470,532 issued May 17, 1949, and Hazan et al., U.S. Patent No. 5,721,418 issued Feb. 24, 1998, also share disadvantages similar to those of Bowman. The sole plate of the Thomas design and the moveable sole plate of Hazan both could, when separated from their respective heating elements, retain enough residual heat to damage fabrics or injure a user. This problem is compounded in the Thomas design by the time delay in separating the supporting sole plate from the heated heavy metal plate.

OBJECTS AND ADVANTAGES

Accordingly, it is an object and advantage of the present invention to provide an improved electric pressing iron with a burn prevention device that deploys the instant the iron is left unattended and that effectively prevents the heated sole from causing damage or injury;

A still further object and advantage of the present invention is to provide a pressing iron with a burn prevention device that shields the entire sole of an unattended iron regardless of whether the iron is horizontal or upright;

A still further object and advantage of the present invention is to provide an automatic shut-off switch that will turn off an unattended pressing iron if the iron is in any position other than an upright rest position.

A still further object and advantage of the present invention is to provide an electric pressing iron with a burn prevention device that does not adversely affect the performance of the iron;

Still other objects and advantages of the present invention will become apparent upon consideration of the ensuing description and drawings.

DETAILED DESCRIPTION OF THE INVENTION—FIGS. 1 TO 9

Figure 1:
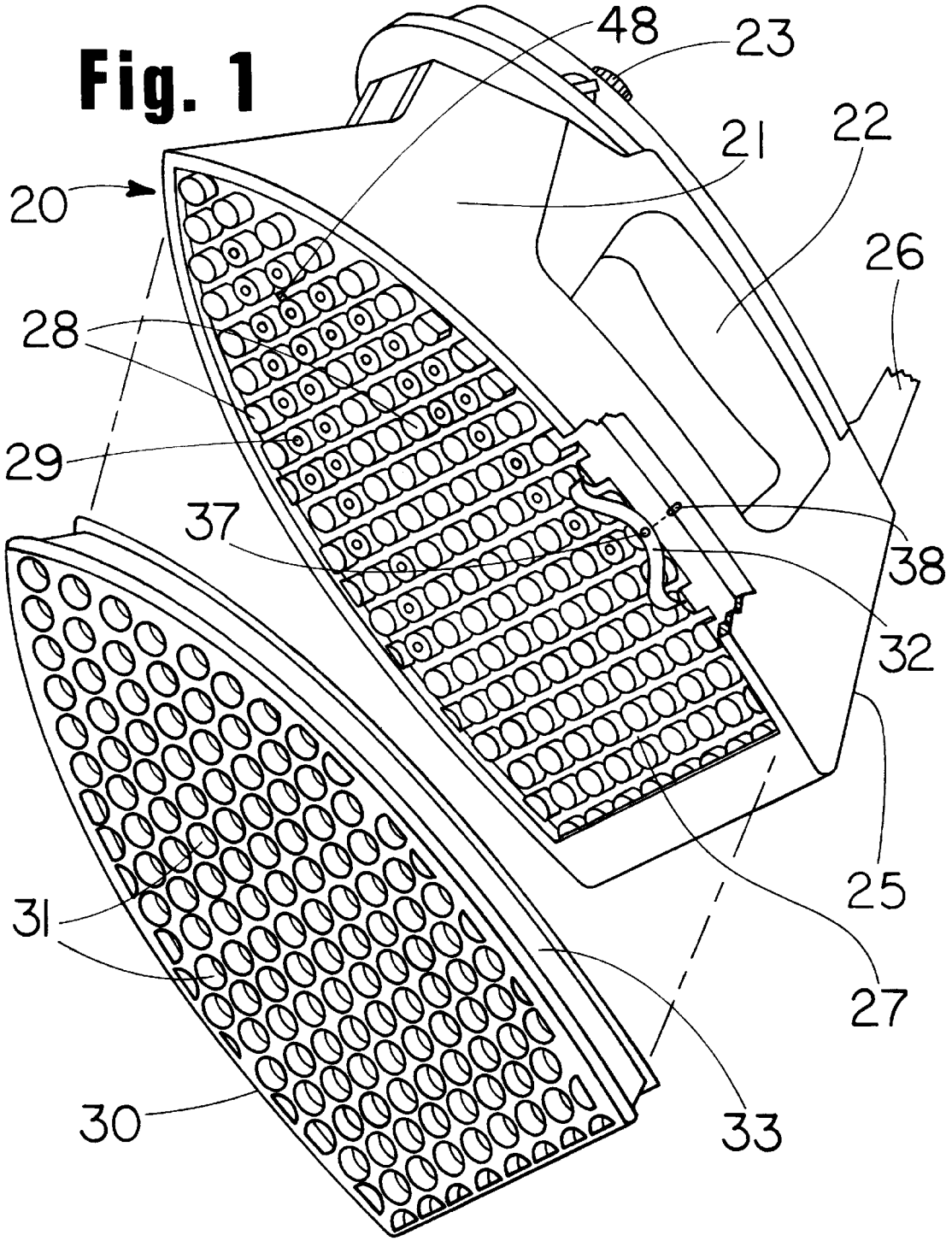
FIG. 1 is a perspective view of a pressing iron constructed in accordance with the present invention showing the burn guard detached from the main body portion of the iron and with a portion of the main body portion cut away to reveal the location of a support spring.

Referring first to FIG. 1, an electric pressing iron 20 has a main body portion 21 and a handle 22. The iron 20 might also include a temperature section knob 23. The main body portion 21 may house a water reservoir and a steam-generating apparatus. Features such as a water spray device can also be included.

A heel rest 25 provides a surface for supporting the iron 20 in an upright resting position, and a line cord 26 provides a source of electrical power. The present design is also compatible with cordless iron arrangements and in such cases the line cord 26 would be omitted.

Fixed to the main body portion 21 is a heated sole plate 27 that is electrically heated in a suitable manner. The sole plate 27 does not provide a flat planar ironing surface. Rather, it includes a number of raised areas 28 that are relatively evenly spaced from one another and that substantially cover the entire area of the sole plate 27. If the iron 20 is equipped with a steam generating apparatus then the raised areas 28 would include steam ports 29. The raised areas 28 extend outward from the sole plate 27 a distance that will be later explained and they all terminate in a common plane.

It is envisioned that the sole plate 27 and raised areas 28 are fashioned from a single piece of material, such as cast aluminum, that is sanded or ground to smooth the distal ends of the raised areas 28 in a uniform manner. The raised areas 28 can also be coated with a non-stick material to reduce friction while ironing.

Figure 2:
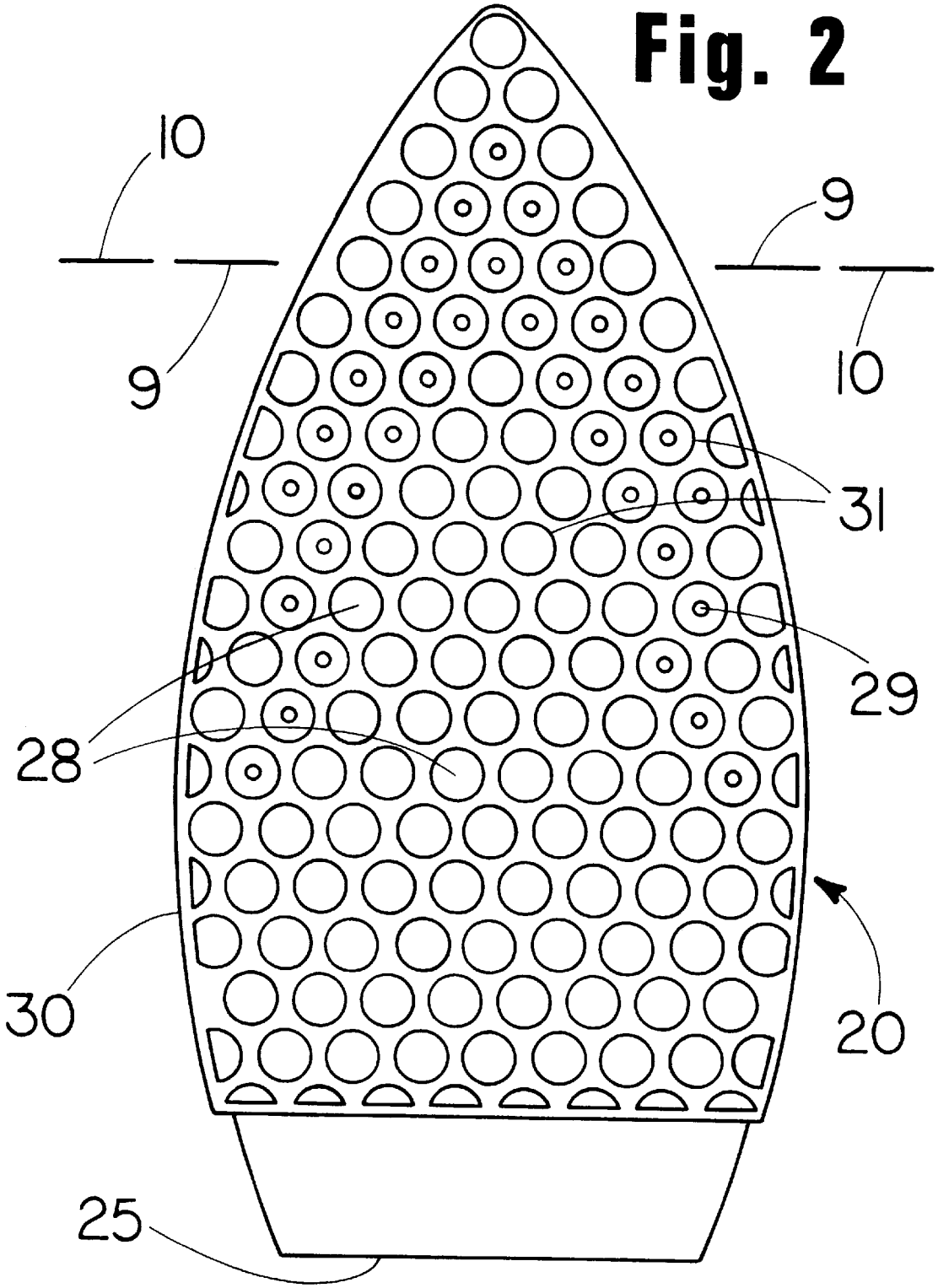
FIG. 2 is a bottom elevation view.

A screen-like burn guard 30 fits over the sole plate 27. The burn guard 30 has openings 31 shaped to precisely accommodate the raised areas 28 of the sole plate 27. The view shown in FIG. 2 illustrates both the even dispersion of the raised areas 28 as well as how they work contiguously in combination with the burn guard 30 to form a complete ironing surface for the iron 20. Though a number of different materials are suitable, the burn guard 30 would ideally be injection-molded from a heat tolerant plastic material.

Figure 3:
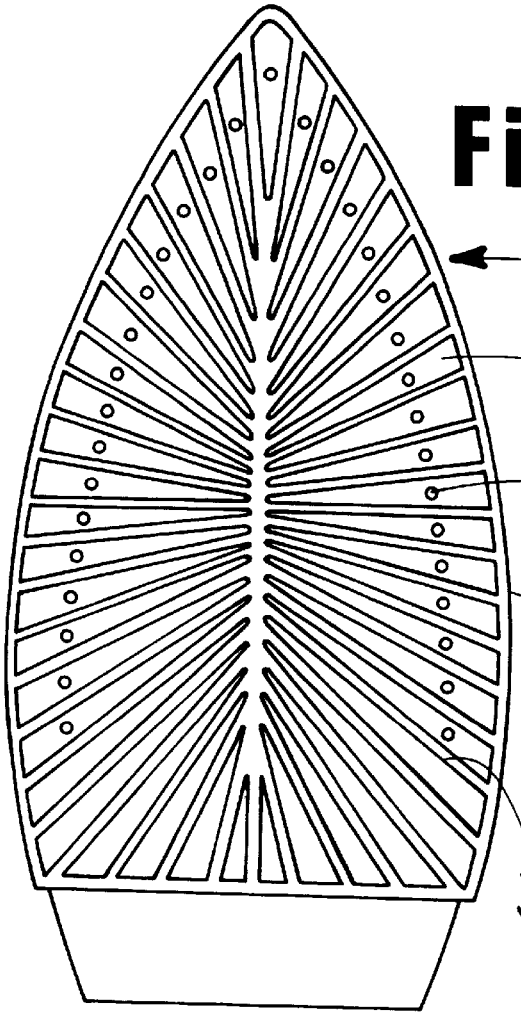
FIG. 3 is a bottom elevation view of an alternative configuration of the invention.
Figure 4:
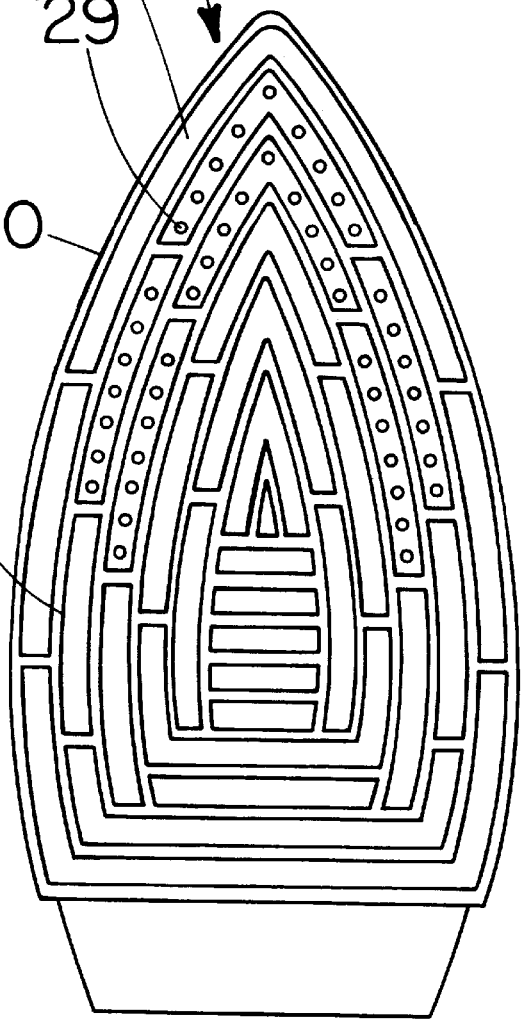
FIG. 4 is a bottom elevation view of a second alternative configuration of the invention.

It should be noted here that FIGS. 1 and 2 show only one possible configuration of the raised areas 28 and openings 31. Numerous other forms are acceptable, and FIGS. 3 and 4 provide two additional examples of how this portion of the iron 20 can appear. Virtually any configuration is okay so long as it operates as described herein.

Referring back to FIG. 1, the burn guard 30 is movably attached to the main body portion 21 of the iron 20 through the use of a series of support springs 32. The burn guard 30 has a wall portion 33 that extends from the entire perimeter of the burn guard 30. This wall portion 33 shields the edge of the sole plate 27 and provides a point at which the support springs 32 can be located in order to control the movement and position of the burn guard 30.

Figure 9:
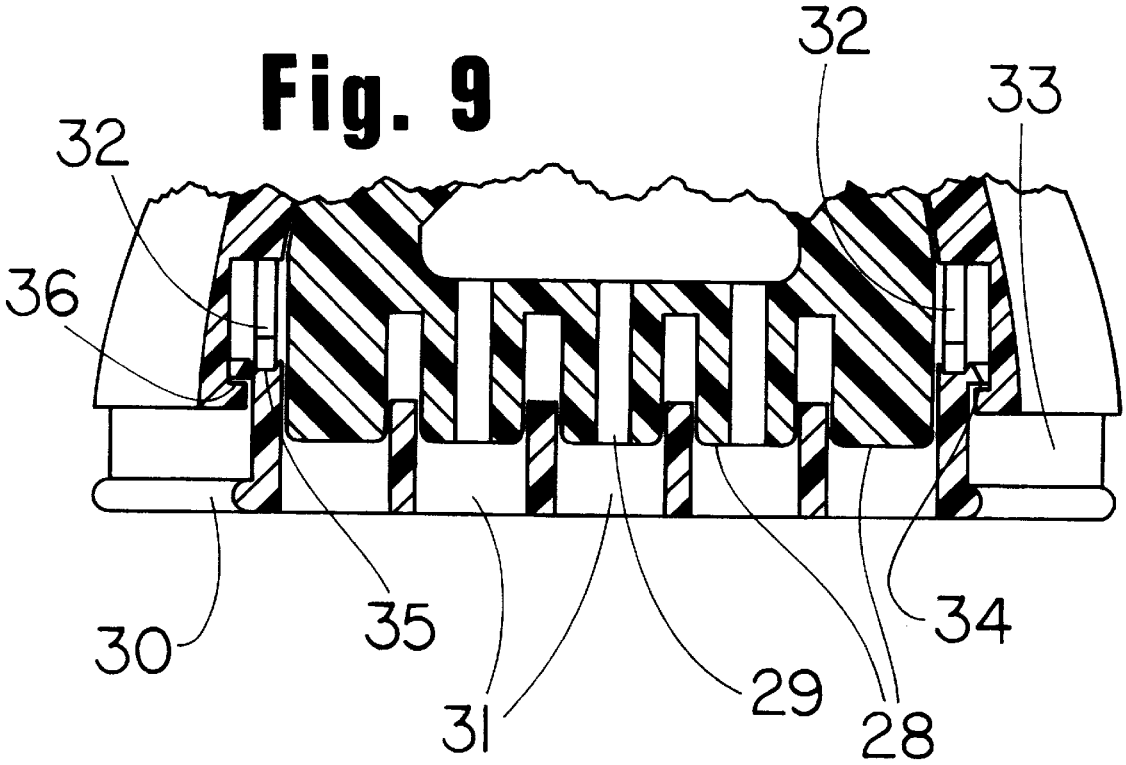
FIG. 9 is an enlarged front cross section view taken along line 9—9 of FIG. 2 illustrating the rest position of the burn guard.

In the preferred embodiment, the top rim of the wall portion 33 includes a lip 34 and a groove 35 as illustrated in FIG. 9. The lip 34 serves to prevent the burn guard 30 from separating from the main body portion 21 by engaging an inner ledge 36 formed in the skirt of the main body portion 21, and the groove 35 functions to keep the support springs 32 in correct alignment with the wall portion 33.

Referring to FIG. 1 again, the support springs 32 are ideally formed from flat narrow pieces of spring steel shaped to resemble double re-curve bows. The middle hump of each support spring 32 can include a hole 37 positioned to receive a pin 38 that secures the support spring 32 to the main body portion 21. In this preferred embodiment the support springs 32 are not affixed to the burn guard 30.

Figure 7:
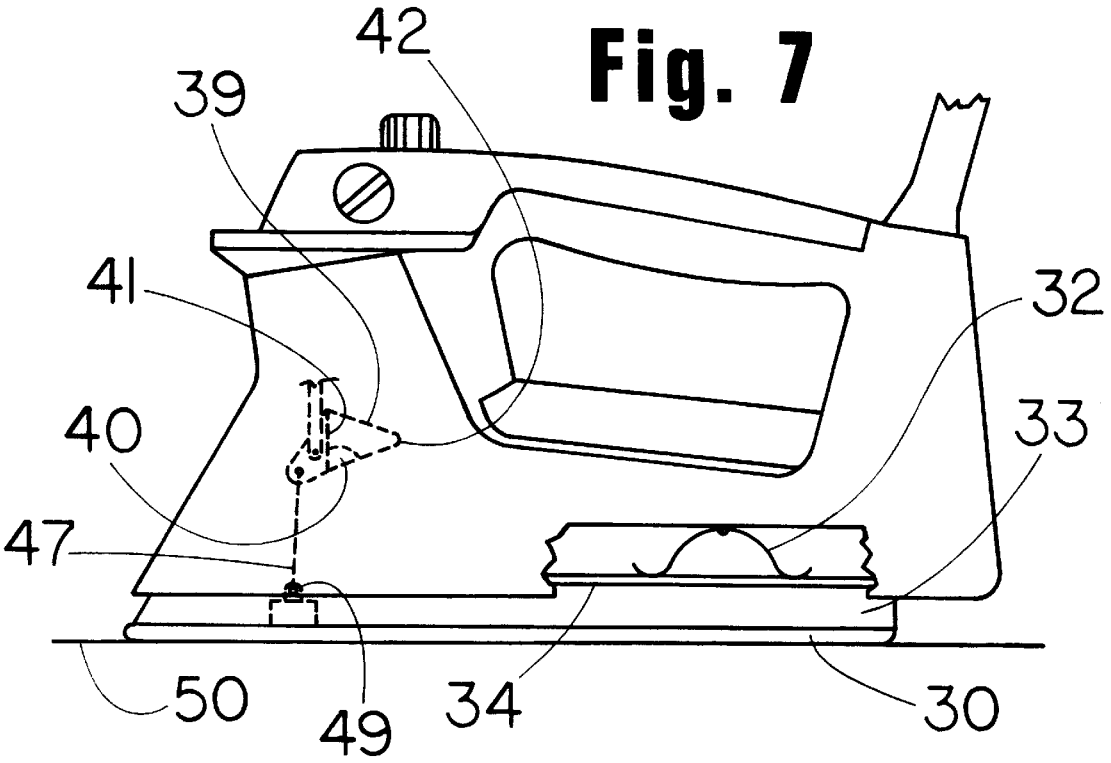
FIG. 7 is a side elevation view showing the iron resting unattended on its base.

The support springs 32 should be evenly spaced around the iron 20 in alignment with the wall portion 33. They should also be of such strength and in such number that, when the iron is placed in a horizontal position on a flat surface 50 as illustrated in FIG. 7, the support springs 32 in combination will be just strong enough to support the weight of the main body portion 21 in a relatively level position with respect to the burn guard 30. In this position the only portion of the iron 20 that is in contact with the flat surface 50 is the burn guard 30. The raised areas 28 will be recessed in the openings 31 due to the action of the support springs 32.

Though only the preferred embodiment is described above, it is noted here that other possibilities exist for connecting the burn guard 30 to the main body portion 21. For example, coil springs can also be used. In this alternative arrangement the springs could be mounted on bosses and enclosed within guide sleeves to prevent distortion of the springs when they are compressed. However, the preferred embodiment described above appears to be less complicated to manufacture and assemble.

The extent of the protection offered by the burn guard 30 is determined by the individual dimensions of the raised areas 28. This is because each opening 31 need only be large enough to accommodate its corresponding raised area 28. If, for example, no raised area 28 has a width or diameter greater than that of a child's finger, and the burn guard 30 is constructed to extend from the sole plate 27 a sufficient distance, there would be a low likelihood that a child could be burned through inadvertent contact with the iron 20. Therefore, a configuration that includes many small raised areas 28 evenly disbursed over the entire sole plate 27 will result in the safest arrangement.

Figure 5:
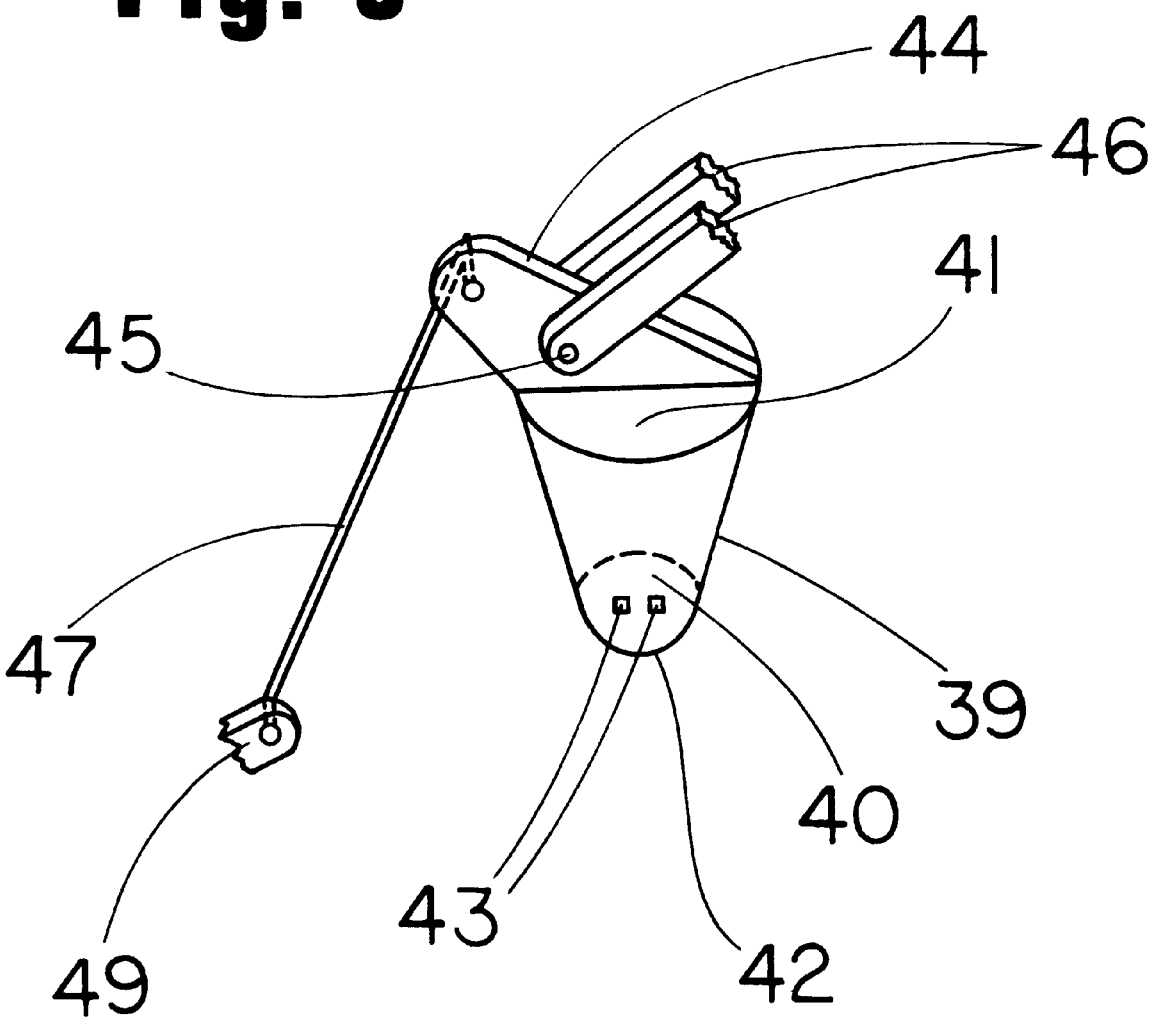
FIG. 5 is a perspective view of the mercury switch.

The iron 20 also has a mechanism that works in conjunction with the burn guard 30 to cut off power to the heating element in certain instances. A mercury switch 39, an overall view of which can be best seen in FIG. 5, is made of a non-conductive material such as glass or plastic. The mercury switch 39 is shaped generally like an inverted cone with a rounded-off tip and has a wide end 41 and a narrow end 42. A quantity of mercury 40 is confined within the mercury switch 39 and free to move about therein.

Located on the narrow end 42 are electrical leads 43 that are connected to the heating element circuit of the iron 20. Though this connection is not shown in the drawings, it would most likely be accomplished through the use of flexible insulated wire. The position of the electrical leads 43 on the narrow end 42 is such that the heating element circuit is closed only when the quantity of mercury 40 is in the narrow end 42 of the mercury switch 39. In this closed circuit position, illustrated in FIG. 5, the quantity of mercury 40 bridges the gap between the two electrical leads 43. The status of the circuit is therefore determined by the orientation of the mercury switch 39.

Still referring to FIG. 5, a flange 44 extends from the wide end 41 on a plane that is substantially in alignment with the centerline of the mercury switch 39. A fixed point 46, positioned at any suitable location within the main body portion 21 of the iron 20, is shaped to receive the flange 44. A hinge pin 45 is used to attach the flange 44 to the fixed point 46. This attachment is such that the mercury switch 39 can rotate approximately ninety degrees in a manner that causes the quantity of mercury 40 to move about and thereby alternately open and close the circuit depending upon the attitude of the iron.

Figure 8:
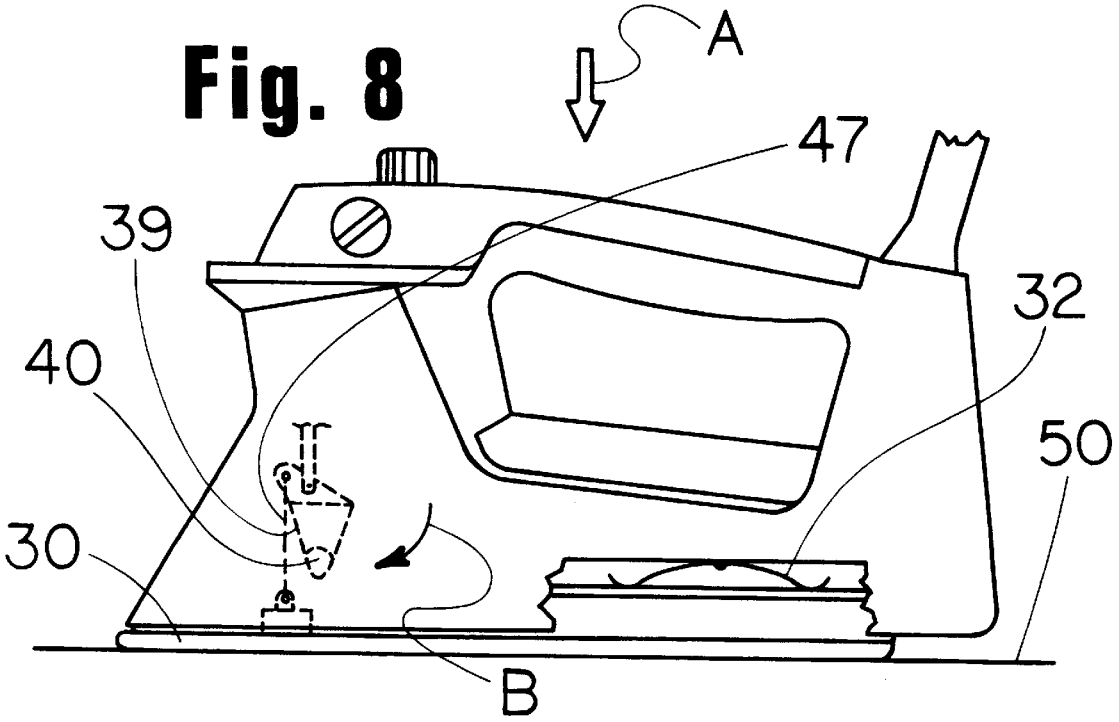
FIG. 8 is a side elevation view showing the iron as it would appear during use.

One extreme of this rotation would result in a position where the centerline of the mercury switch 39 is substantially perpendicular to the plane of the burn guard 30 with the narrow end 42 closer to the burn guard 30 than the wide end 41. This position is illustrated in FIG. 8 and will be more fully explained below. The other extreme would result in the centerline of the mercury switch 39 being substantially parallel to the plane of the burn guard 30 as shown in FIG. 7.

Figure 6:
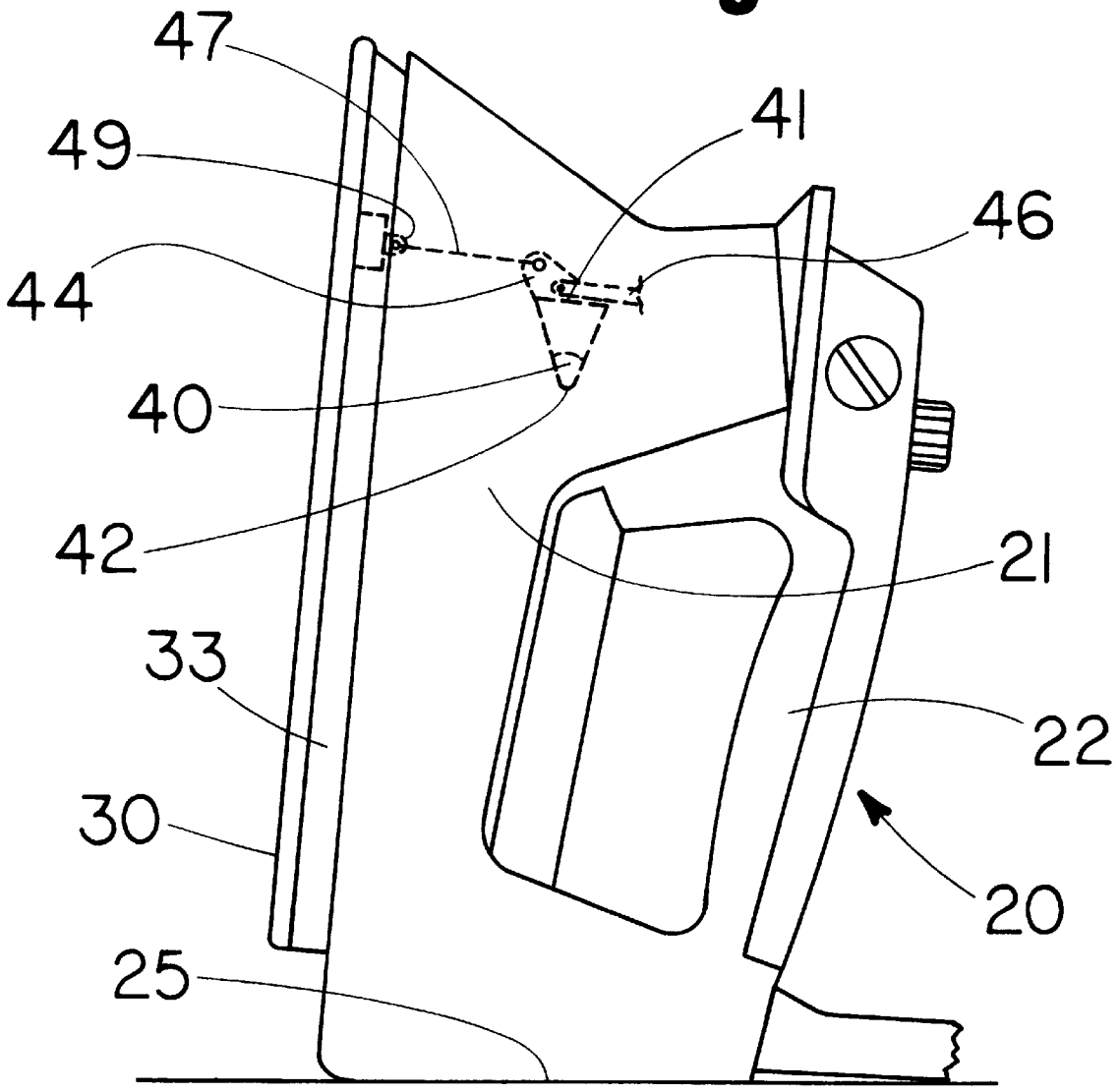
FIG. 6 is a side elevation view showing the iron resting upright on its heel rest.

Also attached to the flange 44 is one end of a rigid connecting arm 47. This attachment is such that the connecting arm 47 is free to pivot at the point of attachment. The connecting arm 47 then passes through a slot 48 in the sole plate 27 between the raised areas 28, as shown in FIG. 1, and the opposite end is attached to the burn guard 30 at a connecting arm hanger 49 as shown in FIGS. 5 and 6. The connecting arm 47 is free to pivot at this point of attachment as well. The purpose of the connecting arm 47 is to coordinate the opening and closing of the mercury switch 39 with movement of the burn guard 30.

The connecting arm 47 is attached to the flange 44 at a point that is a certain distance from the point at which the flange 44 is attached to the fixed point 46. Placing these two points of attachment closer together will result in a greater movement of the mercury switch 39 in response to a given movement of the burn guard 30, and vice versa. The respective points of attachment should be positioned to yield the approximately ninety degrees of rotation discussed above.

Finally, the mercury switch 39 could be mounted in the main body portion 21 and connected to the burn guard 30 in many ways other than that described above. These alternatives would not affect the performance of the present design. The key to the mercury switch 39 lies in its shape, wider at one end than the other, and its connection, by any acceptable manner, to the burn guard 30.

OPERATION OF THE INVENTION—FIGS. 6 TO 11

The burn guard 30 and the mercury switch 39 work together to prevent the iron 20 from burning a user, damaging items being ironed, or starting a fire. The burn guard 30 will expose a heated surface only when a user is actually ironing. Additionally, by operation of the mercury switch 39, the iron 20 will automatically shut off if it is left unattended unless it is resting upright on the heel rest 25.

This upright rest position is shown in FIG. 6. For the remainder of the discussion below it is assumed that the iron 20 is connected to an electrical power source and the user has chosen a desired temperature setting. In the upright rest position the mercury switch 39 is oriented generally in a position such that the wide end 41 is pointed upward and the quantity of mercury 40 has settled in the narrow end 42. This shall be referred to as the vertical position of the mercury switch 39 and it results in a closed circuit with power flowing to the heating element of the iron 20.

Still referring to FIG. 6, the support springs 32 are holding the burn guard 30 away from the sole plate 27. Absent any pressure on the burn guard 30 in the direction of the sole plate 27, the raised areas 28 will remain safely recessed in the openings 31 and thereby prevent any person or object from coming into contact with the hot surface.

If the iron 20 is then placed in a horizontal position but left unattended, as illustrated in FIG. 7, the mercury switch 39 will also be in a horizontal position. Due to the shape of the mercury switch 39, the quantity of mercury 40 will flow to the wide end 41 and open the circuit. Power to the electric heating element will thus be cut off. Additionally, the iron 20 will be resting on the relatively cool burn guard 30 with the support springs 32 holding the main body portion 21, including the sole plate 27, away from the flat surface 50. Turning to the cross section view shown in FIG. 9, when the iron is in this unattended horizontal position the raised areas 28 remain safely recessed and do not contact anything.

Thus, the mercury switch 39 and the burn guard 30 will prevent a fire if a user accidentally leaves the iron 20 in this position.

If the user then applies a slight downward pressure on the handle 22, such as that pressure inherent in the motion used for ironing, the iron 20 will appear as shown in FIG. 8. This downward pressure, in the general direction of arrow "A" in FIG. 8, compresses the support springs 32 and moves the main body portion 21 toward the flat surface 50. When the distal ends of the raised areas 28 contact the flat surface 50 the downward movement will cease.

This movement is transferred from the burn guard 30 to the mercury switch 39 via the connecting arm 47. As a result, the mercury switch 39 pivots, in the direction of arrow "B" in FIG. 8, from its previous horizontal position to a vertical position. By definition this closes the circuit and power is again supplied to the electric heating element.

Figure 10:
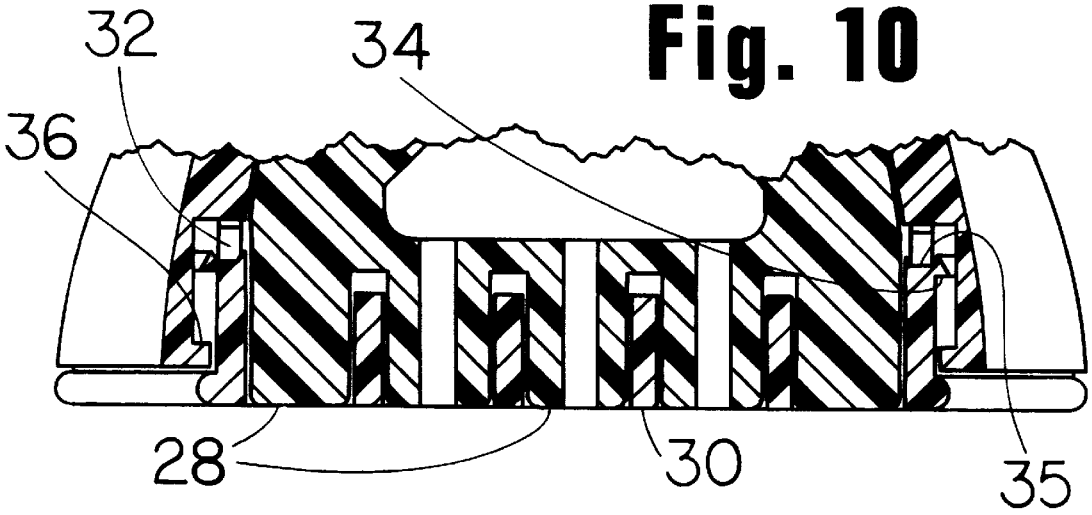
FIG. 10 is an enlarged front cross section view taken along line 10—10 of FIG. 2 illustrating the operation of the burn guard.

The FIG. 10 cross section view of this active ironing position illustrates how the raised areas 28 and burn guard 30 work together to form an even ironing surface. The ends of the raised areas 28 are flush with the outer surface of the burn guard 30 and the iron 20 will perform as if it has a typical flat sole plate. Though the burn guard 30 is not heated, a normal ironing motion will effectively smooth the article being ironed because the numerous raised areas 28 spread evenly over the entire base provide an even heat distribution and the combination of the burn guard 30 and raised areas 28 together form a single complete plane.

If the user was to release their grip on the handle 22 while leaving the iron 20 in this horizontal ironing position, the support springs 32 would instantly lift the main body portion 21 up and away from the surface being ironed. This leaves the iron 20 back as illustrated by FIGS. 7 and 9. The raised areas 28 will be safely recessed within the openings 31, and the mercury switch 39 will return to its horizontal, circuit open, position. Only the relatively cool burn guard 30 would remain n contact with the ironing surface.

Figure 11:
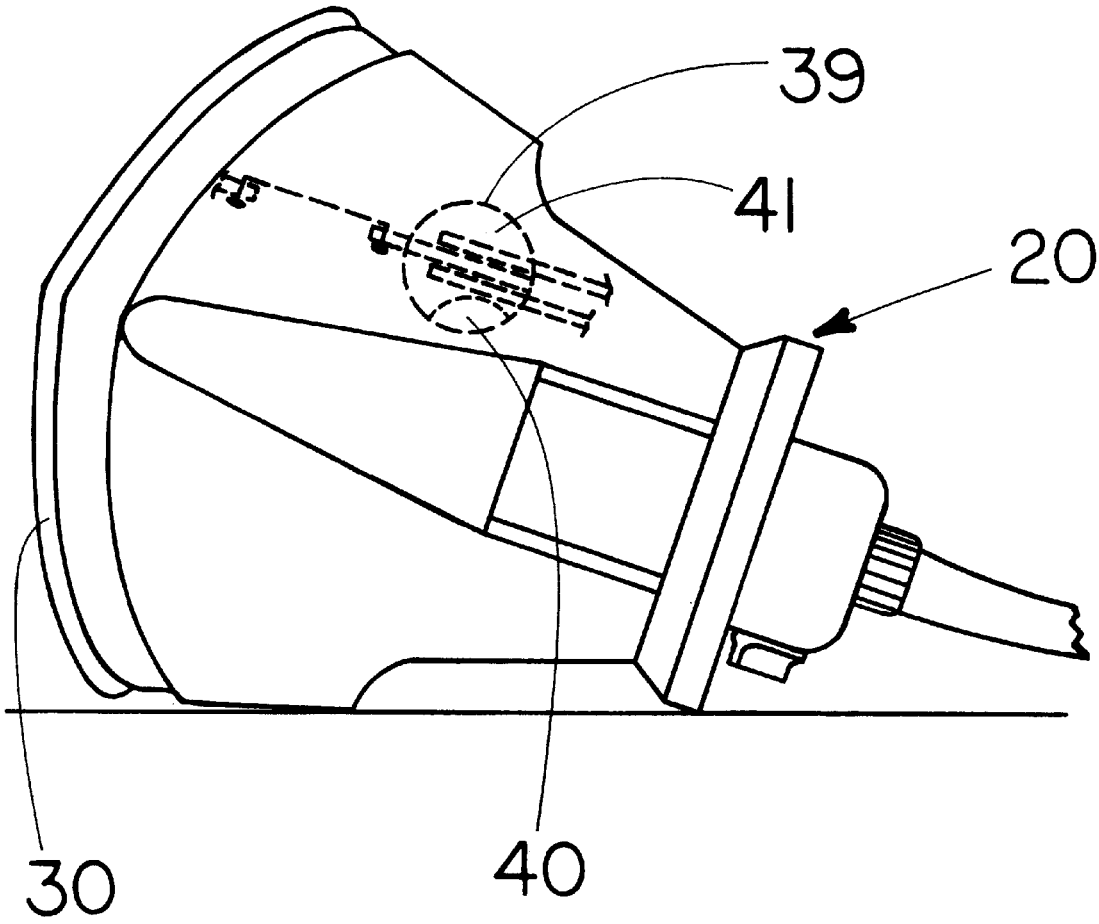
FIG. 11 is a front elevation view of the iron lying on its side.

One final situation that might be encountered is illustrated by FIG. 11. This situation is not uncommon and could occur if a pressing iron is accidentally knocked over by a child or a pet. The iron 20 is unattended and lying horizontally on its side. Again, due to the shape of the mercury switch 39, the horizontal position of the iron 20 will cause the quantity of mercury 40 to flow into the wide end 41. This will open the circuit and cut off the power supply to the iron. Additionally, the burn guard 30 conceals the sole plate 27 to further protect against damage or injury.

SUMMARY, RAMIFICATIONS AND SCOPE

Accordingly, the present invention provides a pressing iron with improved safety features that protect both persons and things. These safety features deploy automatically the instant the iron is left unattended, thus substantially reducing the likelihood of injury or damage. Furthermore, the safety features offered by the design ensure that every portion of the iron that is hot will be shielded whenever the iron is unattended no matter the position of the iron.

The safety features offered by this design also have other advantages in that:

- they are compatible with pressing irons of all sizes and/or that include additional features;

they will provide reliable protection during normal use of a pressing iron; and they will not adversely affect the ironing performance of an iron.

While the above description is very specific, it is not intended to limit the scope of the invention. Therefore, the true scope of the invention should be determined by the appended claims and their legal equivalents rather than the particular embodiments illustrated.

I claim:

1. A pressing iron, comprising:

a main body portion that has a sole plate, the sole plate including a number of raised areas that protrude from the sole plate a certain distance and terminate in a common plane;

means for heating the sole plate;

a burn prevention device comprising a movable shielding element shaped to substantially surround and enclose the sole plate, the burn prevention device including a number of openings that are sized and positioned to cooperatively receive the raised areas such that movement of the burn prevention device towards the sole plate can reach a point at which the burn prevention device coacts with the raised areas to form a substantially flat surface;

means for limiting the maximum movement of the burn prevention device in a direction away from the sole plate.

2. A pressing iron as set forth in claim 1, wherein:

the main body portion includes spring means that normally bias the burn prevention device in a direction away from the sole plate, the spring means being strong enough to support the weight of the main body portion in a manner that leaves the raised areas recessed within the openings when the iron is resting horizontally on the burn prevention device.

3. A pressing iron as set forth in claim 1, wherein:

the raised areas are generally evenly spaced from one another and substantially cover the entire sole plate.

4. A pressing iron, comprising:

a main body portion that has a sole plate heated by an electric heating element, the sole plate including a number of raised areas that protrude from the sole plate a certain distance and terminate in a common plane;

a burn prevention device comprising a movable shielding element shaped to substantially surround and enclose the sole plate, the burn prevention device including a number of openings that are sized and positioned to cooperatively receive the raised areas such that movement of the burn prevention device towards the sole plate can reach a point at which the burn prevention device coacts with the raised areas to form a substantially flat surface;

means for limiting the maximum movement of the burn prevention device in a direction away from the sole plate;

spring means that normally bias the burn prevention device in a direction away from the sole plate, the spring means being strong enough to support the weight of the main body portion in a manner that leaves the raised areas recessed within the openings when the iron is resting horizontally on the burn prevention device;

a mercury switch in series with the electric heating element for the sole plate, the mercury switch containing a quantity of mercury and being pivotally supported in the main body portion such that pivoting movement of the mercury switch can cause the quantity of mercury to move about therein and alternately open and close the circuit, and the mercury switched situated such that when the pressing iron is in an upright position with the sole plate oriented vertically the heating element circuit will be closed;

means for coordinating pivoting movement of the mercury switch with movement of the burn prevention device such that, when the pressing iron is resting in an ironing position on the burn prevention device with the sole plate oriented horizontally the mercury switch will interrupt the heating element circuit and, alternatively, when a user applies pressure on the pressing iron in the direction of a surface being ironed the movement of the burn prevention device towards the sole plate will cause the mercury switch to pivot and close the circuit.

5. A pressing iron as set forth in claim 4, wherein:

the mercury switch has a wide end and a narrow end and is connected to the heating element circuit such that the switch will provide a closed circuit only when the quantity of mercury is in the narrow end;

the mercury switch is situated such that, absent any external force tending to compress the spring means, any horizontal position of the pressing iron will cause the quantity of mercury to flow into the wide end and thereby interrupt the circuit regardless of whether the iron is resting on the burn prevention device or on a portion of the main body portion.

* * * * *